US011122653B2

(12) United States Patent
Roumpedaki et al.

(10) Patent No.: US 11,122,653 B2
(45) Date of Patent: Sep. 14, 2021

(54) INTERMEDIATE TRANSITION BETWEEN AN ANTENNA AND A COPLANAR WAVEGUIDE TRANSMISSION LINE OF A SOLID STATE AMPLIFIER

(71) Applicant: WHIRLPOOL CORPORATION, Benton Harbor, MI (US)

(72) Inventors: Natalia Roumpedaki, Ternate (IT); Francesco Giordano, Cremona (IT)

(73) Assignee: Whirlpool Corporation, Benton Harbor, MI (US)

( * ) Notice: Subject to any disclaimer, the term of this patent is extended or adjusted under 35 U.S.C. 154(b) by 274 days.

(21) Appl. No.: 16/308,064

(22) PCT Filed: Sep. 28, 2017

(86) PCT No.: PCT/US2017/054031
§ 371 (c)(1),
(2) Date: Dec. 7, 2018

(87) PCT Pub. No.: WO2018/064342
PCT Pub. Date: Apr. 5, 2018

(65) Prior Publication Data

US 2019/0313487 A1 Oct. 10, 2019

Related U.S. Application Data

(60) Provisional application No. 62/402,088, filed on Sep. 30, 2016.

(51) Int. Cl.

| | |
|---|---|
| ***H05B 6/68*** | (2006.01) |
| ***H05B 6/70*** | (2006.01) |
| ***H05B 6/72*** | (2006.01) |

(52) U.S. Cl.
CPC ..... *H05B 6/686* (2013.01); *H05B 6/707* (2013.01); *H05B 6/72* (2013.01)

(58) Field of Classification Search
CPC ..... H05B 6/686; H05B 6/72; H05B 6/707
(Continued)

(56) References Cited

U.S. PATENT DOCUMENTS

| | | | |
|---|---|---|---|
| 2,742,612 | A | 4/1956 | Cohn |
| 3,265,995 | A | 8/1966 | Hamasaki |

(Continued)

FOREIGN PATENT DOCUMENTS

| | | | |
|---|---|---|---|
| RU | 2253193 | C2 | 5/2005 |
| WO | 03034790 | A2 | 4/2003 |
| WO | 2016144872 | A1 | 9/2016 |

*Primary Examiner* — Quang T Van
(74) *Attorney, Agent, or Firm* — Price Heneveld LLP

(57) ABSTRACT

A microwave oven having an enclosed cavity is provided including an RF signal generator; a solid state amplifier having a coplanar waveguide transmission line, the amplifier coupled to the RF signal generator for receiving and amplifying the RF signals generated thereby; an intermediate transition including: a metal boundary having a first section and a second section having different dimensions than that of the first section; a first dielectric disposed in the first section; a second dielectric disposed in the second section; and a center conductor extending from a first side of the substrate to a second side of the substrate through the first and second dielectrics, where a first end of the center conductor is connected to an output of the amplifier; and an antenna coupled to a second end of the center conductor for receiving the amplified RF signals and introducing electromagnetic radiation into the cavity.

20 Claims, 5 Drawing Sheets

(58) Field of Classification Search
USPC ..... 219/678, 750, 746, 748, 716, 761, 696, 219/702, 693, 697, 754, 704, 756, 745, 219/715, 709
See application file for complete search history.

(56) References Cited

U.S. PATENT DOCUMENTS

| | | | | |
|---|---|---|---|---|
| 3,737,812 | A | 6/1973 | Gaudio et al. | |
| 4,139,828 | A | 2/1979 | Commault et al. | |
| 8,823,461 | B2 | 9/2014 | Shi et al. | |
| 9,288,849 | B2 | 3/2016 | Shi et al. | |
| 2007/0045297 | A1 | 3/2007 | Pare et al. | |
| 2008/0134778 | A1 | 6/2008 | Osswald et al. | |
| 2012/0038432 | A1 | 2/2012 | Andrews | |
| 2012/0305808 | A1 | 12/2012 | Zhylkov et al. | |
| 2013/0278345 | A1 | 10/2013 | Shi et al. | |
| 2014/0266864 | A1 | 9/2014 | Frederiksson | |
| 2016/0183332 | A1* | 6/2016 | Frank | H05B 6/642 219/728 |
| 2016/0198530 | A1 | 7/2016 | Piel et al. | |
| 2018/0152998 | A1* | 5/2018 | Rollet | H05B 6/6438 |
| 2019/0208588 | A1* | 7/2019 | Brindani | H05B 6/664 |

* cited by examiner

INTERMEDIATE TRANSITION BETWEEN AN ANTENNA AND A COPLANAR WAVEGUIDE TRANSMISSION LINE OF A SOLID STATE AMPLIFIER

BACKGROUND

The present device generally relates to methods and structures for coupling an antenna to a coplanar waveguide (CPW) transmission line of a solid state amplifier, and more specifically, to a solid state microwave oven having a structure for coupling an antenna to a CPW transmission line of a solid state amplifier.

SUMMARY

In at least one aspect, a microwave oven having an enclosed cavity is provided including an RF signal generator for generating RF signals having selected frequencies and phases; a solid state amplifier comprising a coplanar waveguide transmission line, the solid state amplifier coupled to the RF signal generator for receiving and amplifying the RF signals; an intermediate transition including: a metal boundary having a first section and a second section having different dimensions than that of the first section; a first dielectric disposed in the first section; a second dielectric disposed in the second section; and a center conductor extending from a first side of the metal boundary to a second side of the metal boundary through the first dielectric and the second dielectric, where a first end of the center conductor is connected to an output of the solid state amplifier; and an antenna coupled to a second end of the center conductor for receiving the amplified RF signals and introducing electromagnetic radiation having frequencies and phases of the amplified RF signals into the enclosed cavity.

According to another aspect, an RF feed is provided for a microwave oven having an enclosed cavity. The RF feed comprises an intermediate transition and an antenna. The intermediate transition comprises: a metal boundary having a first section and a second section having different dimensions than that of the first section; a first dielectric disposed in the first section; a second dielectric disposed in the second section; and a center conductor extending from a first side of the metal boundary to a second side of the metal boundary through the first dielectric and the second dielectric, where a first end of the center conductor is connected to an output of a solid state amplifier to receive amplified RF signals therefrom. The antenna is coupled to a second end of the center conductor for receiving the amplified RF signals and introducing electromagnetic radiation having frequencies and phases of the amplified RF signals into the enclosed cavity.

According to another aspect, an RF feed is provided for a microwave oven having an enclosed cavity. The RF feed comprises an intermediate transition and an antenna. The intermediate transition comprises: a metal boundary having a first section and a second section having different dimensions than that of the first section, wherein the first and second sections have different cross-sectional shapes and different lengths; a first dielectric disposed in the first section; a second dielectric disposed in the second section, wherein the first and second dielectrics have different dielectric properties; and a center conductor extending from a first side of the metal boundary to a second side of the metal boundary through the first dielectric and the second dielectric, where a first end of the center conductor is connected to an output of a solid state amplifier to receive amplified RF signals therefrom. The antenna is coupled to a second end of the center conductor for receiving the amplified RF signals and introducing electromagnetic radiation having frequencies and phases of the amplified RF signals into the enclosed cavity.

These and other features, advantages, and objects of the present device will be further understood and appreciated by those skilled in the art upon studying the following specification, claims, and appended drawings.

DETAILED DESCRIPTION OF EMBODIMENTS

Figure 1:
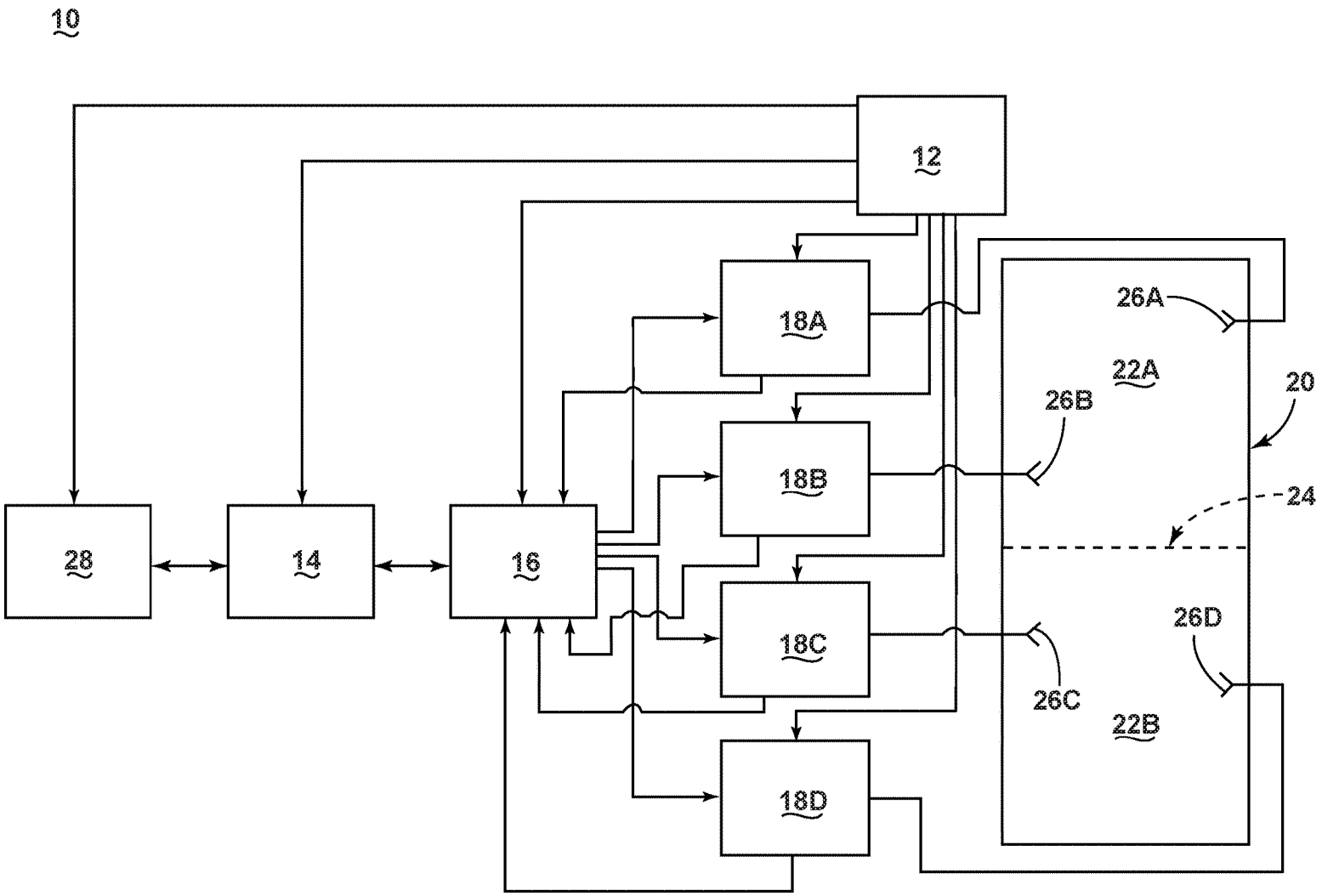
FIG. 1 is a block diagram of an electromagnetic cooking device with multiple coherent radio frequency feeds in accordance with various aspects described herein.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As stated above, the present device generally relates to methods and structures for coupling an antenna to a coplanar waveguide (CPW) transmission line of a solid state amplifier, and more specifically, to a solid state microwave oven having a structure for coupling an antenna to a CPW transmission line of a solid state amplifier. Prior to describing the methods and structures for coupling an antenna to a CPW transmission line of a solid state amplifier, a solid-state radio frequency (RF) cooking appliance, such as a microwave oven, is described below in which the methods and structures may be implemented.

A solid-state radio frequency (RF) cooking appliance heats up and prepares food by introducing electromagnetic radiation into an enclosed cavity. Multiple RF feeds at different locations in the enclosed cavity produce dynamic electromagnetic wave patterns as they radiate. The wave patterns in the enclosed cavity can be controlled and shaped using the multiple RF feeds that can radiate waves with separately controlled electromagnetic characteristics to maintain coherence (that is, a stationary interference pattern) within the enclosed cavity. For example, each RF feed can transmit a different frequency, phase and/or amplitude with respect to the other feeds. Other electromagnetic characteristics can be common among the RF feeds. For example, each RF feed can transmit at a common but variable frequency. Although the following embodiments are directed to a cooking appliance where RF feeds direct electromagnetic radiation to heat an object in an enclosed cavity, it will be understood that the methods described herein and the inventive concepts derived herefrom are not so limited. The covered concepts and methods are applicable to any RF device where electromagnetic radiation is directed to an enclosed cavity to act on an object inside the cavity. Exemplary devices include ovens, dryers, steamers, and the like.

FIG. 1 shows a block diagram of an electromagnetic cooking device 10 with multiple coherent RF feeds 26A-D according to one embodiment. As shown in FIG. 1, the electromagnetic cooking device 10 includes a power supply 12, a controller 14, an RF signal generator 16, a human-machine interface 28 and multiple high-power RF amplifiers 18A-D coupled to the multiple RF feeds 26A-D. The multiple RF feeds 26A-D each couple RF power from one of the multiple high-power RF amplifiers 18A-D into an enclosed cavity 20. As described below, the RF feeds 26A-D may include an antenna.

The power supply 12 provides electrical power derived from mains electricity to the controller 14, the RF signal generator 16, the human-machine interface 28 and the multiple high-power RF amplifiers 18A-D. The power supply 12 converts the mains electricity to the required power level of each of the devices it powers. The power supply 12 can deliver a variable output voltage level. For example, the power supply 12 can output a voltage level selectively controlled in 0.5-Volt steps. In this way, the power supply 12 can be configured to typically supply 28 Volts direct current to each of the high-power RF amplifiers 18A-D, but can supply a lower voltage, such as 15 Volts direct current, to decrease an RF output power level by a desired level.

A controller 14 can be included in the electromagnetic cooking device 10, which can be operably coupled with various components of the electromagnetic cooking device 10 to implement a cooking cycle. The controller 14 can also be operably coupled with a control panel or human-machine interface 28 for receiving user-selected inputs and communicating information to a user. The human-machine interface 28 can include operational controls such as dials, lights, switches, touch screen elements, and displays enabling a user to input commands, such as a cooking cycle, to the controller 14 and receive information. The user interface 28 can include one or more elements, which can be centralized or dispersed relative to each other. The controller 14 may also select the voltage level supplied by power supply 12.

The controller 14 can be provided with a memory and a central processing unit (CPU), and can be preferably embodied in a microcontroller. The memory can be used for storing control software that can be executed by the CPU in completing a cooking cycle. For example, the memory can store one or more pre-programmed cooking cycles that can be selected by a user and completed by the electromagnetic cooking device 10. The controller 14 can also receive input from one or more sensors. Non-limiting examples of sensors that can be communicably coupled with the controller 14 include peak level detectors known in the art of RF engineering for measuring RF power levels and temperature sensors for measuring the temperature of the enclosed cavity or one or more of the high-power amplifiers 18A-D.

Based on the user input provided by the human-machine interface 28 and data including the forward and backward (or reflected) power magnitudes coming from the multiple high-power amplifiers 18A-D (represented in FIG. 1 by the path from each of the high-power amplifiers 18A-D through the RF signal generator 16 to the controller 14), the controller 14 can determine the cooking strategy and calculate the settings for the RF signal generator 16. In this way, one of the main functions of the controller 14 is to actuate the electromagnetic cooking device 10 to instantiate the cooking cycle as initiated by the user. The RF signal generator 16 as described below then can generate multiple RF waveforms, that is, one for each high-power amplifier 18A-D based on the settings indicated by the controller 14.

The high-power amplifiers 18A-D, each coupled to one of the RF feeds 26A-D, each output a high-power RF signal based on a low power RF signal provided by the RF signal generator 16. The low power RF signal input to each of the high-power amplifiers 18A-D can be amplified by transforming the direct current electrical power provided by the power supply 12 into a high-power radio frequency signal. In one non-limiting example, each high-power amplifier 18A-D can be configured to output an RF signal ranging from 50 to 250 Watts. The maximum output wattage for each high-power amplifier can be more or less than 250 Watts depending upon the implementation. Each high-power amplifier 18A-D can include a dummy load to absorb excessive RF reflections.

The multiple RF feeds 26A-D couple power from the multiple high-power RF amplifiers 18A-D to the enclosed cavity 20. The multiple RF feeds 26A-D can be coupled to the enclosed cavity 20 in spatially separated but fixed physical locations. The multiple RF feeds 26A-D can be implemented via waveguide structures designed for low power loss propagation of RF signals. In one non-limiting example, metallic, rectangular waveguides known in microwave engineering are capable of guiding RF power from a high-power amplifier 18A-D to the enclosed cavity 20 with a power attenuation of approximately 0.03 decibels per meter.

Additionally, each of the RF feeds 26A-D can include a sensing capability to measure the magnitude of the forward and the backward power levels or phase at the amplifier output. The measured backward power indicates a power level returned to the high-power amplifier 18A-D as a result of an impedance mismatch between the high-power amplifier 18A-D and the enclosed cavity 20. Besides providing feedback to the controller 14 and the RF signal generator 16 to implement, in part, a cooking strategy, the backward power level can indicate excess reflected power that can damage the high-power amplifier 18A-D.

Along with the determination of the backward power level at each of the high-power amplifiers 18A-D, temperature sensing at the high-power amplifier 18A-D, including at the dummy load, can provide the data necessary to determine if the backward power level has exceeded a predetermined threshold. If the threshold is exceeded, any of the controlling elements in the RF transmission chain including the power supply 12, controller 14, the RF signal generator 16, or the high-power amplifier 18A-D can determine that the high-power amplifier 18A-D can be switched to a lower power level or completely turned off. For example, each high-power amplifier 18A-D can switch itself off automatically if the backward power level or sensed temperature is too high for several milliseconds. Alternatively, the power supply 12 can cut the direct current power supplied to the high-power amplifier 18A-D.

The enclosed cavity 20 can selectively include subcavities 22A-B by insertion of an optional divider 24 therein. The enclosed cavity 20 can include, on at least one side, a shielded door to allow user access to the interior of the enclosed cavity 20 for placement and retrieval of food or the optional divider 24.

The transmitted bandwidth of each of the RF feeds 26A-D can include frequencies ranging from 2.4 GHz to 2.5 GHz. The RF feeds 26A-D can be configured to transmit other RF bands. For example, the bandwidth of frequencies between 2.4 GHz and 2.5 GHz is one of several bands that make up the industrial, scientific and medical (ISM) radio bands. The transmission of other RF bands is contemplated and can include non-limiting examples contained in the ISM bands defined by the frequencies: 13.553 MHz to 13.567 MHz, 26.957 MHz to 27.283 MHz, 902 MHz to 928 MHz, 5.725 GHz to 5.875 GHz, and 24 GHz to 24.250 GHz.

Figure 2:
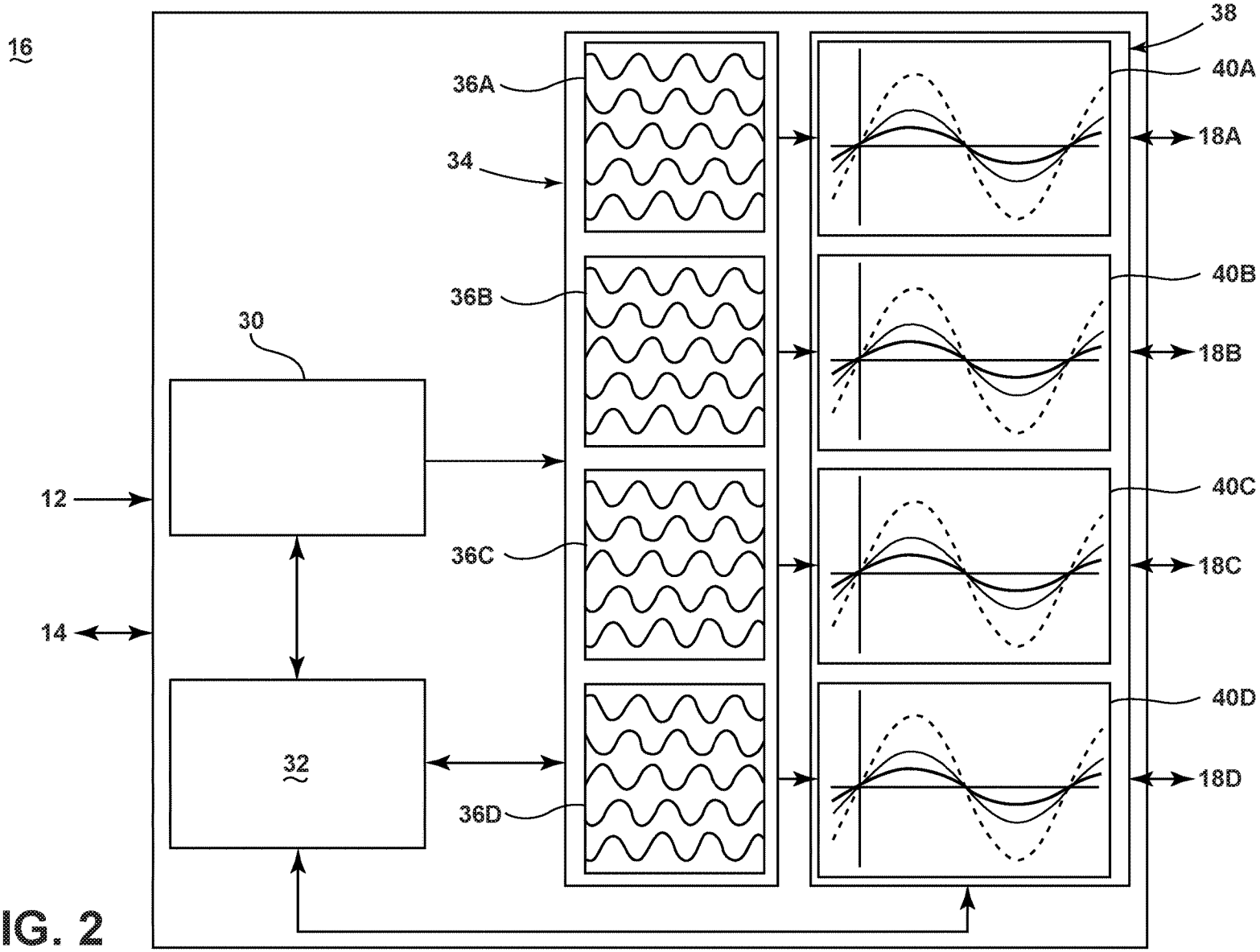
FIG. 2 is a block diagram of a radio frequency signal generator of FIG. 1.
Figure 5:
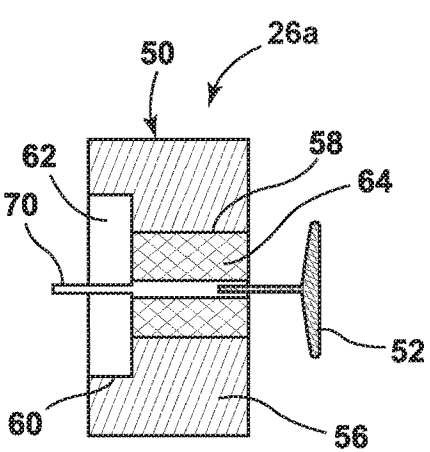
FIG. 5 is a cross-sectional view of the intermediate transition shown in FIG. 3.

Referring now to FIG. 2, a block diagram of the RF signal generator 16 is shown. The RF signal generator 16 includes a frequency generator 30, a phase generator 34 and an amplitude generator 38 sequentially coupled and all under the direction of an RF controller 32. In this way, the actual frequency, phases and amplitudes to be output from the RF signal generator 16 to the high-power amplifiers are programmable through the RF controller 32, preferably implemented as a digital control interface. The RF signal generator 16 can be physically separate from the cooking controller 14 or can be physically mounted onto or integrated into the controller 14. The RF signal generator 16 is preferably implemented as a bespoke integrated circuit.

As shown in FIG. 2 the RF signal generator 16 outputs four RF channels 40A-D that share a common but variable frequency (e.g. ranging from 2.4 GHz to 2.5 GHz), but are settable in phase and amplitude for each RF channel 40A-D. The configuration described herein is exemplary and should not be considered limiting. For example, the RF signal generator 16 can be configured to output more or less channels and can include the capability to output a unique variable frequency for each of the channels depending upon the implementation.

As previously described, the RF signal generator 16 can derive power from the power supply 12 and input one or more control signals from the controller 14. Additional inputs can include the forward and backward power levels determined by the high-power amplifiers 18A-D. Based on these inputs, the RF controller 32 can select a frequency and signal the frequency generator 30 to output a signal indicative of the selected frequency. As represented pictorially in the block representing the frequency generator 30 in FIG. 2, the selected frequency determines a sinusoidal signal whose frequency ranges across a set of discrete frequencies. In one non-limiting example, a selectable bandwidth ranging from 2.4 GHz to 2.5 GHz can be discretized at a resolution of 1 MHz allowing for 101 unique frequency selections.

After the frequency generator 30, the signal is divided per output channel and directed to the phase generator 34. Each channel can be assigned a distinct phase, that is, the initial angle of a sinusoidal function. As represented pictorially in the block representing the per channel phase generator 36A-D in FIG. 2, the selected phase of the RF signal for a channel can range across a set of discrete angles. In one non-limiting example, a selectable phase (wrapped across half a cycle of oscillation or 180 degrees) can be discretized at a resolution of 10 degrees allowing for 19 unique phase selections per channel.

Subsequent to the phase generator 34, the RF signal per channel can be directed to the amplitude generator 38. The RF controller 32 can assign each channel (shown in FIG. 2 with a common frequency and distinct phase) to output a distinct amplitude in the channel 40A-D. As represented pictorially in the block representing the per channel amplitude generator in FIG. 2, the selected amplitude of the RF signal can range across a set of discrete amplitudes (or power levels). In one non-limiting example, a selectable amplitude can be discretized at a resolution of 0.5 decibels across a range of 0 to 23 decibels allowing for 47 unique amplitude selections per channel.

The amplitude of each channel 40A-D can be controlled by one of several methods depending upon the implementation. For example, control of the supply voltage of the amplitude generator 38 for each channel can result in an output amplitude for each channel 40A-D from the RF signal generator 16 that is directly proportional to the desired RF signal output for the respective high-power amplifier 18A-D. Alternatively, the per channel output can be encoded as a pulse-width modulated signal where the amplitude level is encoded by the duty cycle of the pulse-width modulated signal. Yet another alternative is to coordinate the per channel output of the power supply 12 to vary the supply voltage supplied to each of the high-power amplifiers 18A-D to control the final amplitude of the RF signal transmitted to the enclosed cavity 20.

As described above, the electromagnetic cooking device 10 can deliver a controlled amount of power at multiple RF feeds 26A-D into the enclosed cavity 20. Further, by maintaining control of the amplitude, frequency and phase of the power delivered from each RF feed 26A-D, the electromagnetic cooking device 10 can coherently control the power delivered into the enclosed cavity 20. Coherent RF sources deliver power in a controlled manner to exploit the interference properties of electromagnetic waves. That is, over a defined area of space and duration of time, coherent RF sources can produce stationary interference patterns such that the electric field is distributed in an additive manner. Consequently, interference patterns can add to create an electromagnetic field distribution that is greater in amplitude than any of the RF sources (i.e. constructive interference) or less than any of the RF sources (i.e. destructive interference).

The coordination of the RF sources and characterization of the operating environment (i.e. the enclosed cavity and the contents within) can enable coherent control of the electromagnetic cooking and maximize the coupling of RF power with an object in the enclosed cavity 20. Efficient transmission into the operating environment can require calibration of the RF generating procedure. As described above, in an electromagnetic heating system, the power level can be controlled by many components including the voltage output from the power supply 12, the gain on stages of variable gain amplifiers including both the high-power amplifiers 18A-D and the amplitude generator 38, the tuning frequency of the frequency generator 30, etc. Other factors that affect the output power level include the age of the components, inter-component interaction and component temperature.

Additional details of an example of high-power amplifiers 18A-D are disclosed in published PCT Application Publication No. WO2016196939A1, the entire disclosure of which is incorporated herein by reference.

Figure 4:
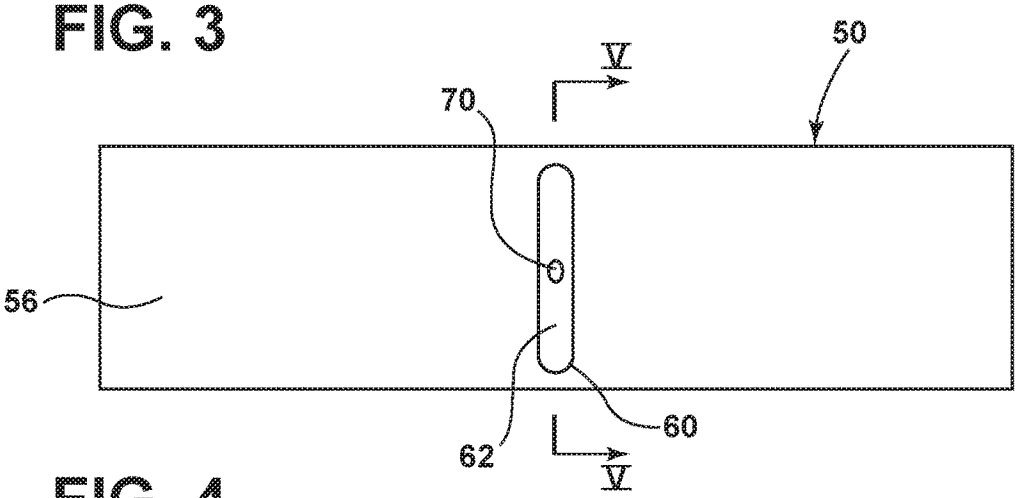
FIG. 4 is a side view of the intermediate transition shown in FIG. 3 as viewed from the side that abuts the high-power solid state amplifier.

FIGS. 3-6 show an RF feed 26*a* having an intermediate transition 50 according to a first embodiment. The intermediate transition 50 may be positioned between an antenna 52 and a CPW transmission line portion 54 of a high-power solid state amplifier 18A. The intermediate transition 50 includes a generally rectangular metal boundary 56 having a first section 60 with certain dimensions and a second section 58 with dimensions different from the first section 60. The first section 60 opens towards a first side of the metal boundary 56 that faces the high-power amplifier 18A and the second section 58 opens at a second side of the metal boundary 56 opposite the first side. As best shown in FIG. 4, the first section 60 may have, but is not limited to, a cross section of oblong shape.

The first section 60 is filled with a first dielectric 62 and the second section 58 is filled with a second dielectric 64. The first dielectric 62 may be made of a different material than the second dielectric 64 so as to provide different dielectric properties (dielectric constant and loss factor) depending from the impedance matching desired.

The size, shape, and the dielectric properties of the first and second dielectrics 62 and 64 will determine impedance matching as well as minimize potential field discontinuity between the various sections.

Figure 6:
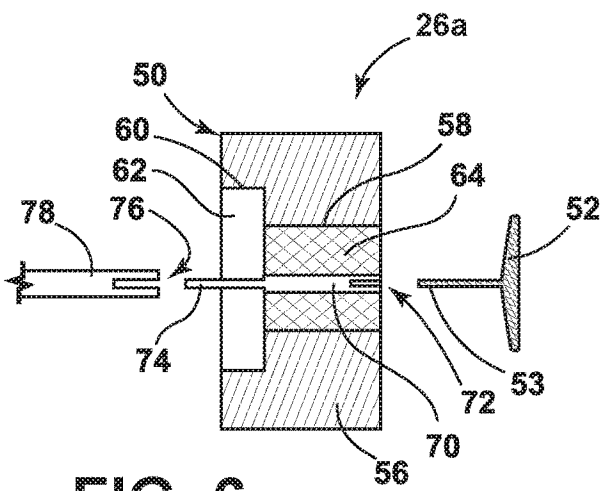
FIG. 6 is an exploded cross-sectional view of the intermediate transition shown in FIG. 3.
Figure 3:
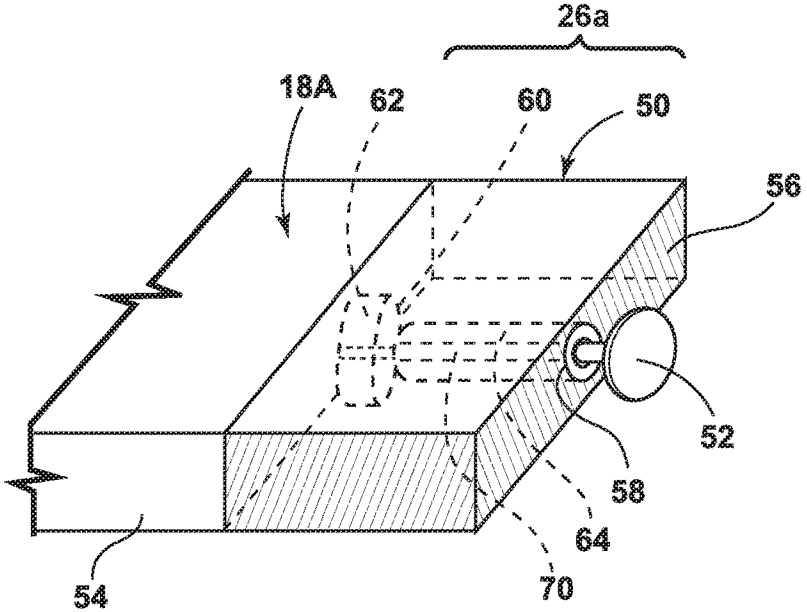
FIG. 3 is a perspective view of an intermediate transition according to a first embodiment shown between an antenna and a CPW transmission line of a high-power solid state amplifier.

A center conductor 70, properly designed is provided generally through the centers of first dielectric 62 and second dielectric 64. As best shown in FIG. 6, the center conductor 70 has a first opening 72 at one end for receiving an end pin 53 of the antenna 52 and has a narrowed end pin 74 at the other end for inserting into an opening 76 in an output conductor of the CPW transmission line 54.

An advantage of using the intermediate transition 50 is that the solid state amplifier 18A may be connected to the antenna 52 and a waveguide without using a coaxial connector or cables. Another advantage is keeping the impedance matching in the transition chain between the amplifier 18A and the antenna 52. Such a direct transition also helps to "smooth out" the discontinuity in the different E-field distributions that would otherwise exist between a coaxial line and a CPW line. Additionally, the use of the intermediate transition 50 results in smaller electromagnetic losses and thus lower heat dissipation on both the amplifier and antenna sides of the intermediate transition.

Figure 7:
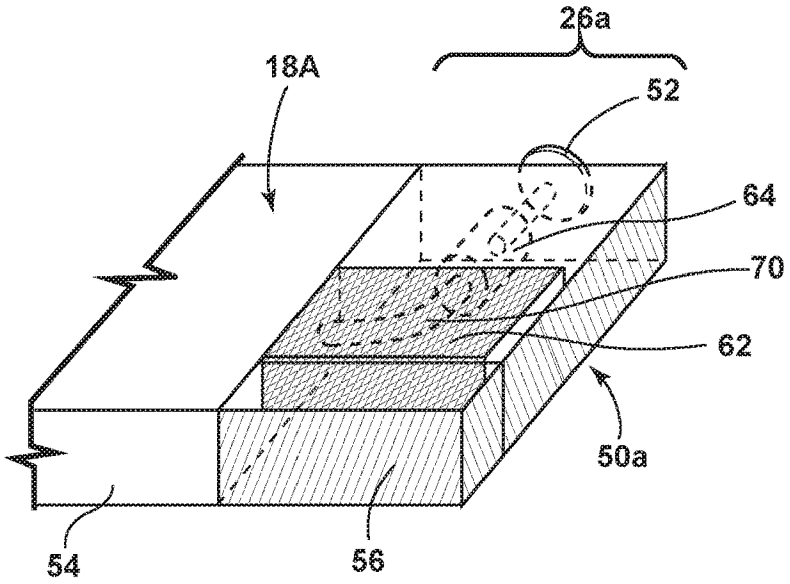
FIG. 7 is a perspective view of an intermediate transition according to a second embodiment shown between an antenna and a CPW transmission line of a high-power solid state amplifier.
Figure 8:
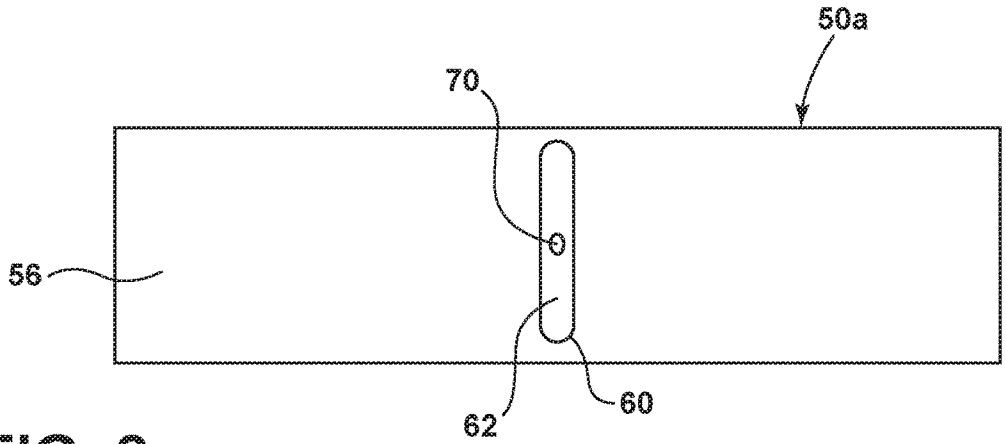
FIG. 8 is a side view of the intermediate transition shown in FIG. 7 as viewed from the side that abuts the high-power solid state amplifier.
Figure 9:
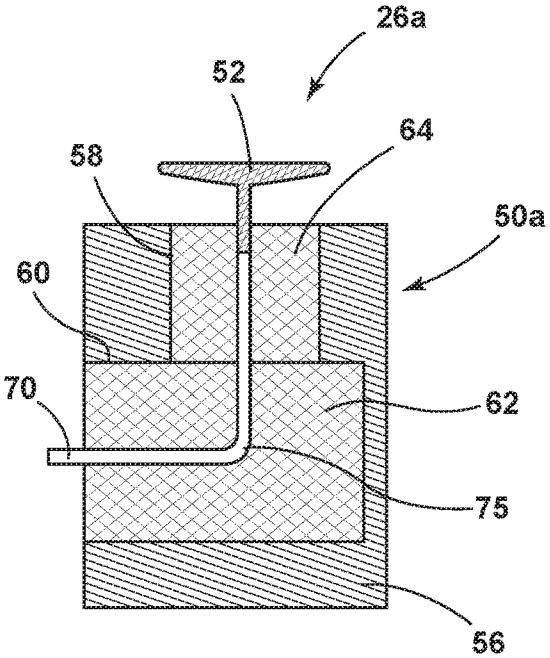
FIG. 9 is a cross-sectional view of the intermediate transition shown in FIG. 7.

FIGS. 7-9 show an RF feed 26*a* having an intermediate transition 50*a* according to a second embodiment. The intermediate transition 50*a* may be positioned between an antenna 52 and a CPW transmission line portion 54 of a high-power solid state amplifier 18A. This embodiment differs from the first embodiment in that the second section 58 is perpendicular to the first section 60 such that the second section 58 opens to a side of the metal boundary 56 that is adjacent the first side that abuts the amplifier 18A. The center conductor 70 therefore has a 90 degree bend 75 within the first dielectric 60.

Figure 10:
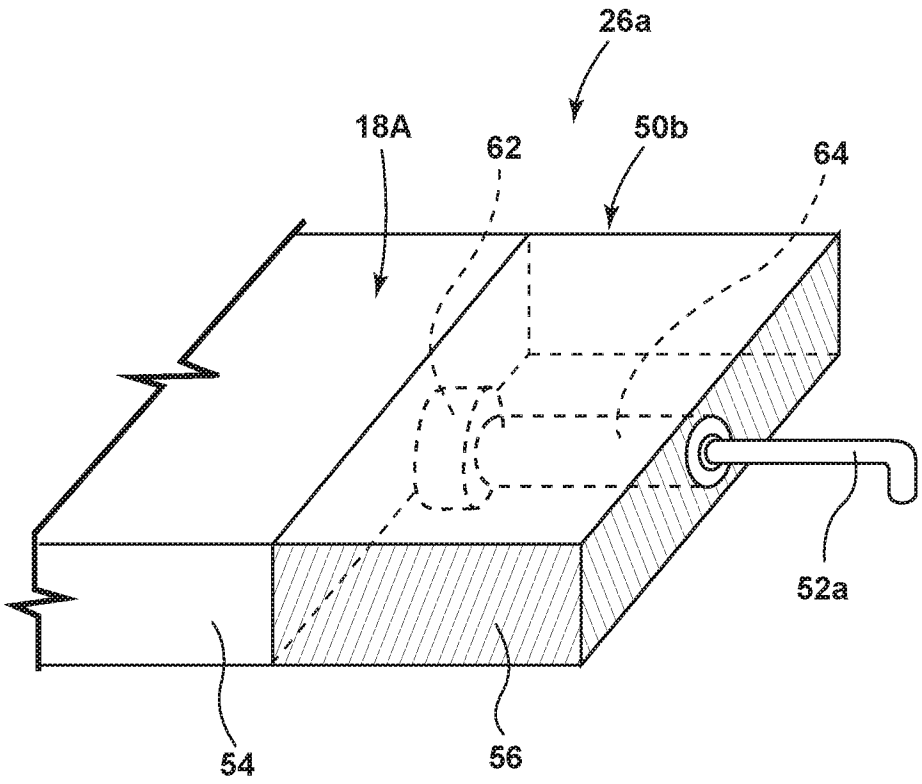
FIG. 10 is a perspective view of an intermediate transition according to a third embodiment shown between an antenna and a CPW transmission line of a high-power solid state amplifier.

FIG. 10 shows an RF feed 26*a* having an intermediate transition 50*b* according to a third embodiment. The intermediate transition 50*b* may be positioned between an antenna 52*a* and a CPW transmission line portion 54 of a high-power solid state amplifier 18A. This embodiment differs from the first embodiment in that a different form of antenna 52*a* may be used. Although two different antennae are shown, it should be appreciated that any form of antenna could be used with the intermediate transitions 50, 50*a*, and 50*b* of the three embodiments.

It will be understood by one having ordinary skill in the art that construction of the described device and other components is not limited to any specific material, shape, and size. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A microwave oven comprising:

an enclosed cavity in which a food load may be placed;

an RF signal generator for generating RF signals having selected frequencies and phases;

a solid state amplifier comprising a coplanar waveguide transmission line, the solid state amplifier coupled to the RF signal generator for receiving and amplifying the RF signals;

an intermediate transition comprising:

a metal boundary having a first section and a second section having different dimensions than that of the first section;

a first dielectric disposed in the first section;

a second dielectric disposed in the second section; and a center conductor extending from a first side of the metal boundary to a second side of the metal boundary through the first dielectric and the second dielectric, where a first end of the center conductor is connected to an output of the solid state amplifier; and an antenna coupled to a second end of the center conductor for receiving the amplified RF signals and introducing electromagnetic radiation having frequencies and phases of the amplified RF signals into the enclosed cavity.

2. The microwave oven of claim 1, wherein the first side of the metal boundary abuts the solid state amplifier and the second side of the metal boundary is opposite the first side.

3. The microwave oven of claim 1, wherein the first side of the metal boundary abuts the solid state amplifier and the second side of the metal boundary is adjacent the first side.

4. The microwave oven of claim 1, wherein the first and second sections have different cross-sectional shapes.

5. The microwave oven of claim 1, wherein the first and second sections have different lengths.

6. The microwave oven of claim 1, wherein the first and second dielectrics have different dielectric properties.

7. The microwave oven of claim 1, wherein the second end of the center conductor has an opening for receiving a conductive pin of the antenna.

8. The microwave oven of claim 1, wherein the first end of the center conductor has a narrowed cross-section for inserting into an opening formed in an output conductor of the solid state amplifier.

9. An RF feed for a microwave oven having an enclosed cavity, the RF feed comprising:

an intermediate transition comprising:

a metal boundary having a first section and a second section having different dimensions than that of the first section;

a first dielectric disposed in the first section;

a second dielectric disposed in the second section; and a center conductor extending from a first side of the metal boundary to a second side of the metal boundary through the first dielectric and the second dielectric, where a first end of the center conductor is connected to an output of a solid state amplifier to receive amplified RF signals therefrom; and an antenna coupled to a second end of the center conductor for receiving the amplified RF signals and introducing electromagnetic radiation having frequencies and phases of the amplified RF signals into the enclosed cavity.

10. The RF feed of claim 9, wherein the first side of the metal boundary abuts the solid state amplifier and the second side of the metal boundary is opposite the first side.

11. The RF feed of claim 9, wherein the first side of the metal boundary abuts the solid state amplifier and the second side of the metal boundary is adjacent the first side.

12. The RF feed of claim 9, wherein the first and second sections have different cross-sectional shapes.

13. The RF feed of claim 9, wherein the first and second sections have different lengths.

14. The RF feed of claim 9, wherein the first and second dielectrics have different dielectric properties.

15. The RF feed of claim 9, wherein the second end of the center conductor has an opening for receiving a conductive pin of the antenna.

16. The RF feed of claim 9 wherein the first end of the center conductor has a narrowed cross-section for inserting into an opening formed in an output conductor of the solid state amplifier.

17. An RF feed for a microwave oven having an enclosed cavity, the RF feed comprising:

an intermediate transition comprising:

a metal boundary having a first section and a second section having different dimensions than that of the first section, wherein the first and second sections have different cross-sectional shapes and different lengths;

a first dielectric disposed in the first section;

a second dielectric disposed in the second section, wherein the first and second dielectrics have different dielectric properties; and a center conductor extending from a first side of the metal boundary to a second side of the metal boundary through the first dielectric and the second dielectric, where a first end of the center conductor is connected to an output of a solid state amplifier to receive amplified RF signals therefrom; and an antenna coupled to a second end of the center conductor for receiving the amplified RF signals and introducing electromagnetic radiation having frequencies and phases of the amplified RF signals into the enclosed cavity.

18. The RF feed of claim 17, wherein the first side of the metal boundary abuts the solid state amplifier and the second side of the metal boundary is opposite the first side.

19. The RF feed of claim 17, wherein the first side of the metal boundary abuts the solid state amplifier and the second side of the metal boundary is adjacent the first side.

20. The RF feed of claim 17 wherein the second end of the center conductor has an opening for receiving a conductive pin of the antenna.

* * * * *